US007798682B1

(12) United States Patent
Cvek

(10) Patent No.: US 7,798,682 B1
(45) Date of Patent: Sep. 21, 2010

(54) PERSONAL ILLUMINATION CONTROL SYSTEMS AND DEVICES

(76) Inventor: Sava Cvek, 40 Woodland Rd., Jamaica Plain, MA (US) 02130

( * ) Notice: Subject to any disclaimer, the term of this patent is extended or adjusted under 35 U.S.C. 154(b) by 154 days.

(21) Appl. No.: 11/760,676

(22) Filed: Jun. 8, 2007

Related U.S. Application Data

(60) Provisional application No. 60/804,277, filed on Jun. 8, 2006.

(51) Int. Cl.
*F21S 8/08* (2006.01)

(52) U.S. Cl. ..... 362/410; 362/257

(58) Field of Classification Search ..... 362/257, 362/276, 253, 410, 802
See application file for complete search history.

(56) References Cited

U.S. PATENT DOCUMENTS

| | | | | |
|---|---|---|---|---|
| 3,543,019 | A | 11/1970 | Jacobsen | |
| 5,097,400 | A | 3/1992 | Cvek | |
| 5,333,103 | A | 7/1994 | Cvek | |
| 5,477,443 | A | 12/1995 | Cvek | |
| 5,896,564 | A * | 4/1999 | Akama et al. | 455/575.9 |
| 5,909,087 | A * | 6/1999 | Bryde et al. | 315/149 |
| 6,238,061 | B1 * | 5/2001 | McKenzie et al. | 362/253 |
| 6,805,455 | B2 * | 10/2004 | Nielsen et al. | 359/877 |
| 6,896,230 | B2 | 5/2005 | Cvek | |
| 7,044,619 | B2 * | 5/2006 | Sanderlin et al. | 362/253 |
| 2004/0156203 | A1 * | 8/2004 | Hata | 362/395 |
| 2005/0243549 | A1 * | 11/2005 | Ruston | 362/233 |
| 2006/0109649 | A1 * | 5/2006 | Ducharme et al. | 362/231 |
| 2006/0176689 | A1 * | 8/2006 | Dowdy et al. | 362/188 |

* cited by examiner

*Primary Examiner*—Jacob Y Choi
(74) *Attorney, Agent, or Firm*—O'Connell Law Firm

(57) ABSTRACT

An illumination system with an illumination device having a body portion and a light source for emitting light, a personal illumination control unit for enabling an input of control commands, an arrangement for communicating control commands from the personal illumination control unit to the illumination device. The control unit can operate wirelessly and can be removably and replaceably received relative to the illumination device. The control unit can enable progressive brightening and dimming of the light source and can retain predetermined and individually set brightness levels of the light source. The control unit can have a display screen with touch sensitive areas. The display screen can be employed to display images retained in electronic memory, which can be removable. A second illumination device can be independently operable, and an ambient air conditioning arrangement can affect ambient conditions.

7 Claims, 12 Drawing Sheets

PERSONAL ILLUMINATION CONTROL SYSTEMS AND DEVICES

FIELD OF THE INVENTION

The present invention relates generally to illumination. More particularly, disclosed herein are devices and systems for enabling personal control over illumination and other environmental conditions.

BACKGROUND OF THE INVENTION

The prior art has disclosed innumerable illumination devices. Devices and systems are known wherein illumination devices can be turned on and off and dimmed by various methods. Furthermore, systems have been taught wherein multiple illumination devices cooperate to light a given space.

However, there remains a need in the art for systems and devices for providing illumination in a personally controlled format to establish optimal environmental conditions for home and building occupants.

SUMMARY OF THE INVENTION

With an appreciation for the state of the art summarized above, the present inventor set forth with the basic object of providing personal illumination control systems and devices that overcome disadvantages exhibited by the prior art while potentially providing previously unrealized advantages thereover.

A more particular object of embodiments of the invention is to provide personal illumination control systems and devices that can enable a control and adjustment of the lighting provided by the same to accommodate user preferences and characteristics.

Another particular object of embodiments of the invention is to provide an illumination system that can be controlled remotely by a user.

Yet another object of certain embodiments of the invention is to provide an illumination system that can affect ambient air characteristics.

These and in all likelihood further objects and advantages of the present invention will become obvious not only to one who reviews the present specification and drawings but also to those who have an opportunity to experience an embodiment of the illumination devices and systems disclosed herein. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth the foregoing objects, an embodiment of the illumination system can comprise an illumination device with a body portion and a light source for emitting light, a personal illumination control unit with means for enabling an input of light source control commands, and means for communicating light source control commands from the personal illumination control unit to the illumination device.

In certain embodiments, the means for communicating light source control commands can comprise a wireless arrangement. In further manifestations of the invention, the personal illumination control unit can be removably and replaceably received relative to the body portion of the illumination device, such as in relation to a base member of the illumination device. The base member can have a platform with a means for receiving the control unit, and the platform can be extendable and retractable relative to the base member.

The means for enabling an input of light source control commands can take the form of buttons or other means for inducing a selective brightening of the light source and for inducing a selective dimming of the light source. While the configuration of the control unit can vary infinitely within the scope of the invention, one embodiment of the personal illumination control unit is generally disk shaped with truncated wedge-shaped buttons and an on/off switch for turning the light source on and off.

Under certain embodiments, the means for enabling an input of light source control commands can induce the light source to a predetermined brightness level, such as to a given brightness level personally calibrated by either or both of the means for inducing a selective brightening of the light source and the means for inducing a selective dimming of the light source. The personally calibrated brightness level can be retained by the personal illumination control unit, such as by a memory means in combination with a means, such as a button, switch, or the like, for inducing a retaining of the brightness level.

In particular arrangements, the means for inducing the light source to a predetermined brightness level can induce the light, source to a level of brightness upon being turned on that is approximately equal to an individually set level of brightness to which the light source was set prior to being turned off. Further embodiments of the invention can have plural separate means for inducing the light source to predetermined brightness levels, such as to desired lighting conditions corresponding to a given activity or user characteristic. To facilitate bringing the light source to predetermined brightness levels, the illumination system can comprise a light meter for sensing ambient lighting conditions and a means for adjusting light emitted by the light source at least partially based on a sensed lighting condition.

The personal illumination control unit can have a display screen, and the means for enabling an input of light source control commands can comprise touch sensitive areas on the display screen. In such embodiments, the system can additionally include a means, such as a memory card, for receiving electronically retained memory and a means for displaying images retained by the memory medium on the display screen.

A second illumination device can cooperate with the illumination device to provide lighting, and the means for communicating light source control commands can enable the provision of independent commands to the illumination device and to the second illumination device. In certain examples of such embodiments, the illumination device can comprise a task lamp with a light source retained at a distal end of a support arm and the second illumination device can be a fixed source of light, such as an under-cabinet light.

In even further manifestations of the invention, an ambient air conditioning arrangement can be operably associated with the illumination device for affecting air conditions in proximity to the illumination system. The ambient air conditioning arrangement can, by way of example and not limitation, comprise an ionization system, a heater, an air filter, and, additionally or alternatively, an air freshener.

One will appreciate that the foregoing discussion broadly outlines the more important goals and features of the invention to enable a better understanding of the detailed description, that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

It will be appreciated that the personal illumination control systems and devices disclosed herein are subject to widely varied embodiments. However, to ensure that one skilled in the art will be able to understand and, in appropriate cases, practice the present invention, certain preferred embodiments of the broader invention revealed herein are described below and shown in the accompanying drawing figures.

Figure 1:
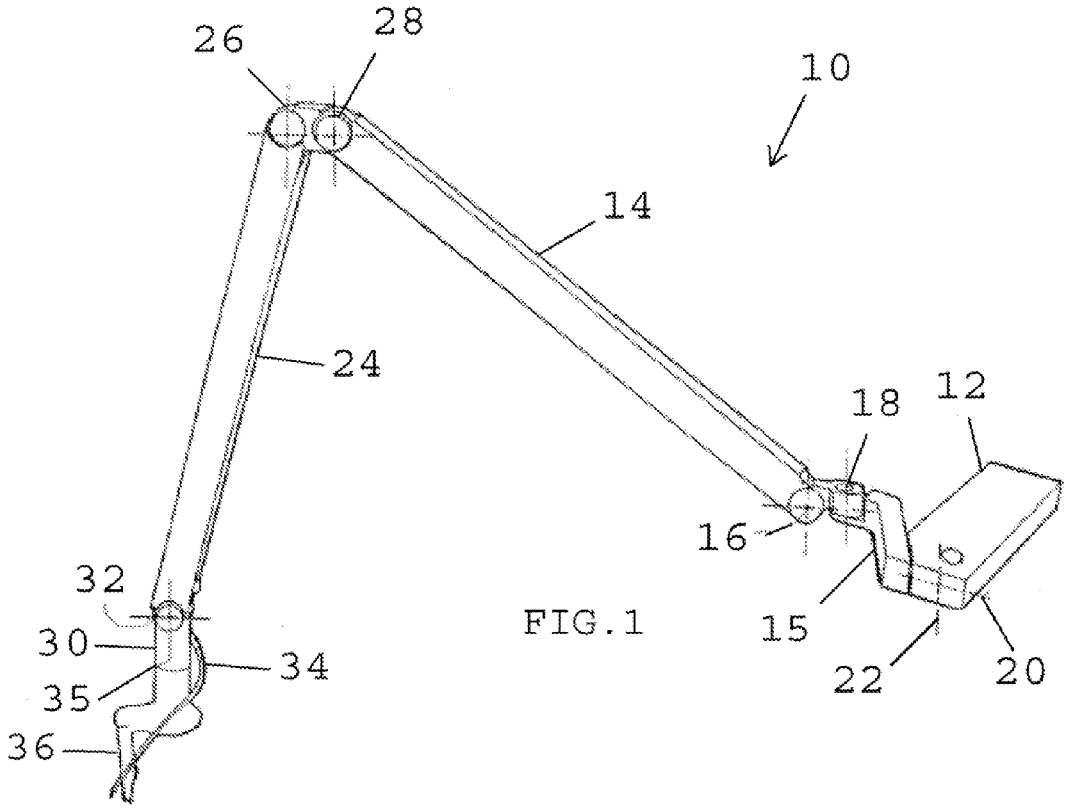
FIG. 1 is a perspective view of an illumination device pursuant to the present invention.
Figure 2:
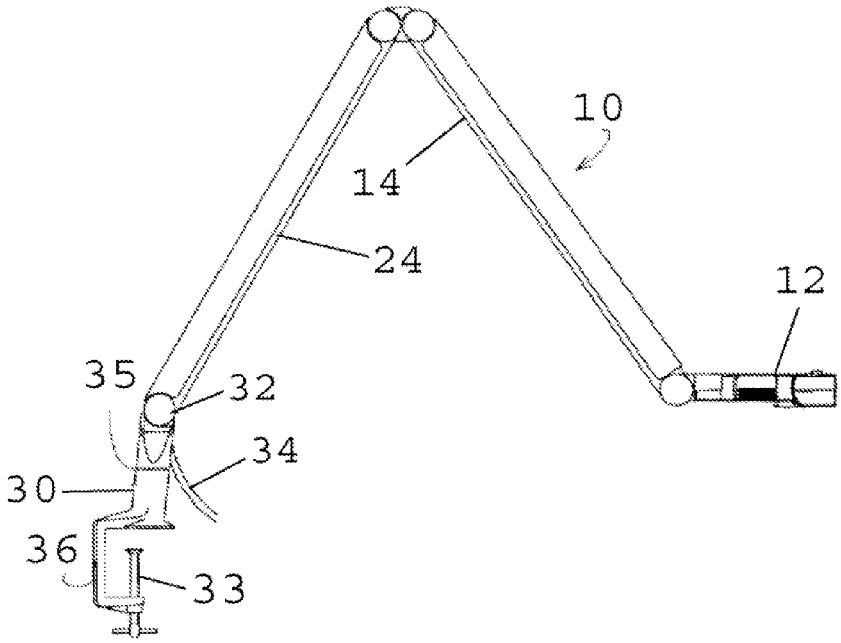
FIG. 2 is a view in side elevation of the illumination device of FIG. 1.
Figure 4:
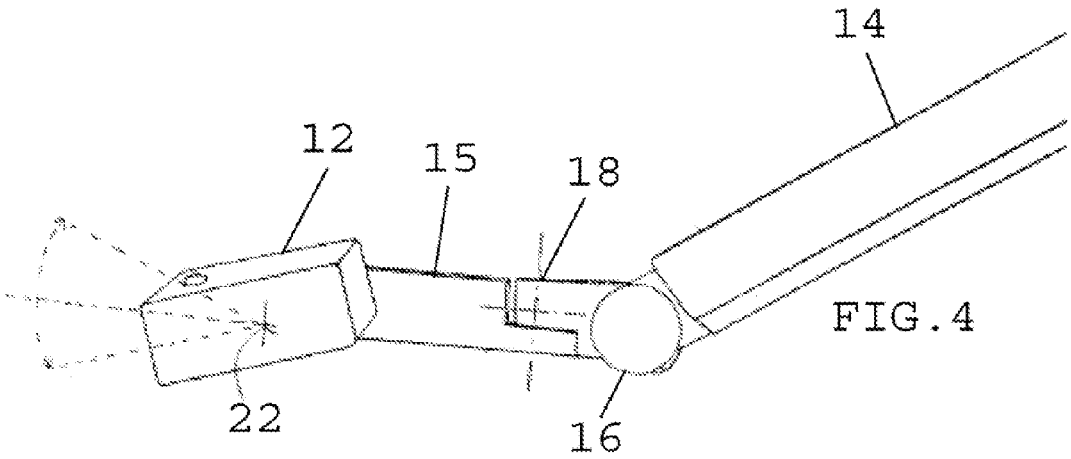
FIG. 4 is a perspective view of a light head according to the instant invention.
Figure 5:
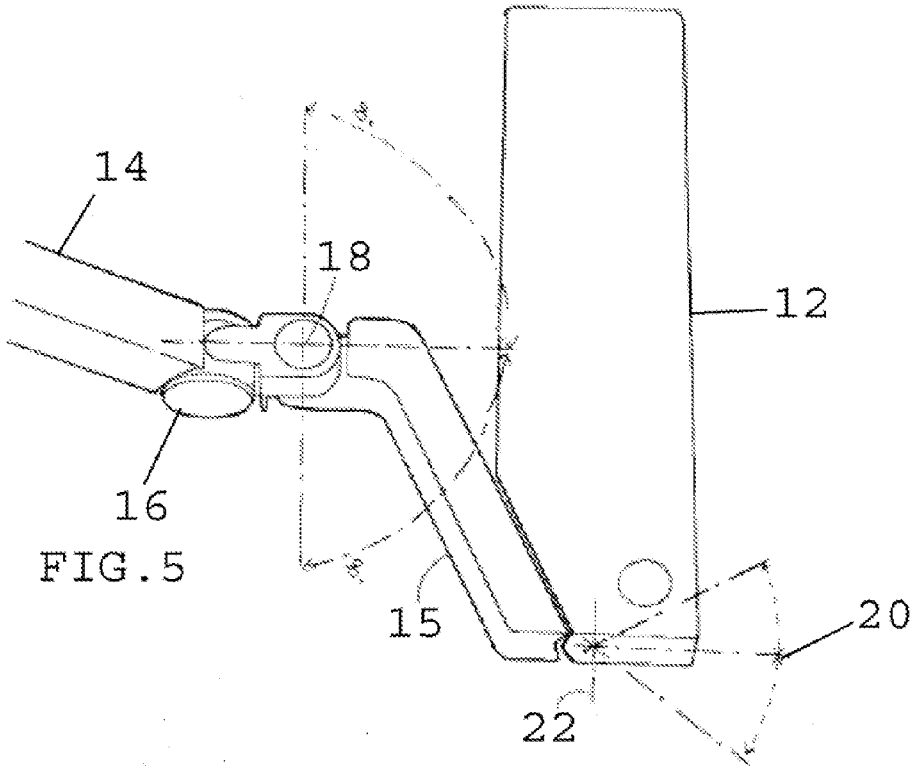
FIG. 5 is an upper perspective view of the light head of FIG. 4.

A first exemplary illumination device pursuant to the present invention is indicated generally at 10 in FIGS. 1 and 2. The illumination device 10 has a light head 12 for providing illumination. The light head 12, which is again shown in FIGS. 4 and 5, is retained for axial and longitudinal pivoting about axes 20 and 22 in relation to a neck 15. The neck 15, in turn, is pivotally coupled to a distal support arm 14 by a pitch axis 16 and a yaw axis 18, which can allow pivoting about 180 degrees. With this, the angular disposition of the light head 12 and the light projected therefrom can be adjusted nearly infinitely.

The distal support arm 14 is pivotally retained relative to a proximal support arm 24 by proximal and distal pivot axes 26 and 28 that can enable parallel movement. The proximal support arm 24 has a proximal end pivotally retained in relation to a base coupling 30 at a pivot axis 32. A base member 36 with a means for supporting the illumination device 10 retains the base coupling 30 to enable a pivoting about a pivot axis 35. Power is supplied to the light head 12 through a power cord 34. In the depicted embodiment, the base member 36 includes a clamping mechanism 33 for enabling clamping in relation to a support surface, such as a desk, counter, or the like (not shown).

Figure 3:
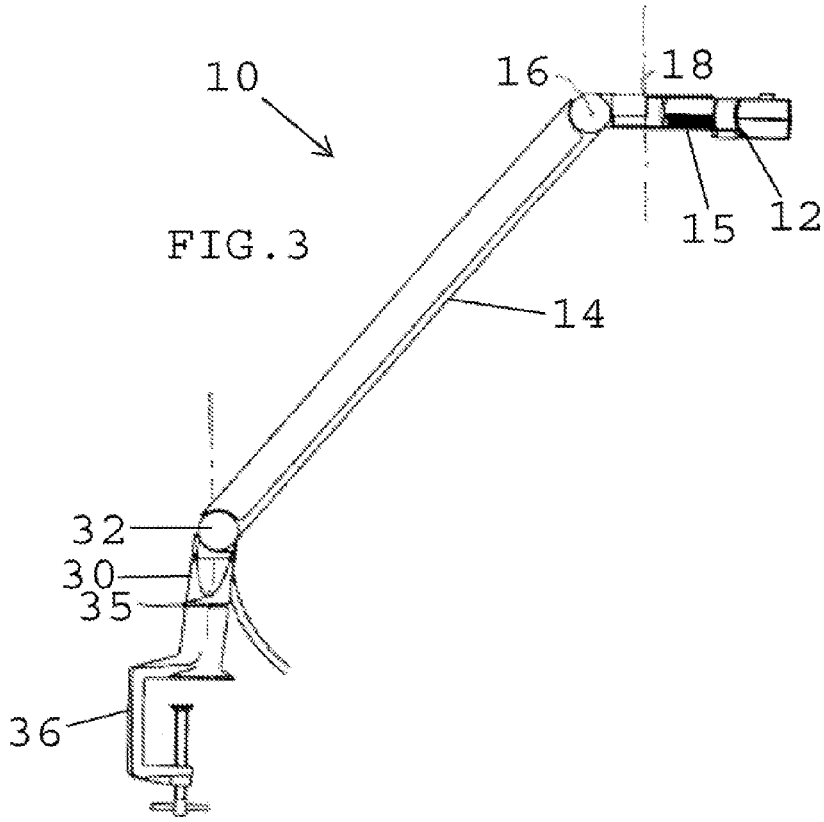
FIG. 3 is a view in side elevation of an alternative illumination device as taught herein.

As FIG. 3 shows, the illumination device 10 could alternatively be constructed with just one support arm 14. The light head 12 is retained relative to a distal end of the support arm 14 with a pitch axis 16 and a yaw axis 18. A proximal end of the support arm 14 is pivotally retained relative to the base coupling 30 at a horizontal pivot axis 32 for enabling a raising and lowering of the support arm 14, and the base coupling 30 is rotatably coupled to a base member 36 at a vertical pivot axis 35 for enabling a lateral pivoting of the support arm 14.

Figure 6:
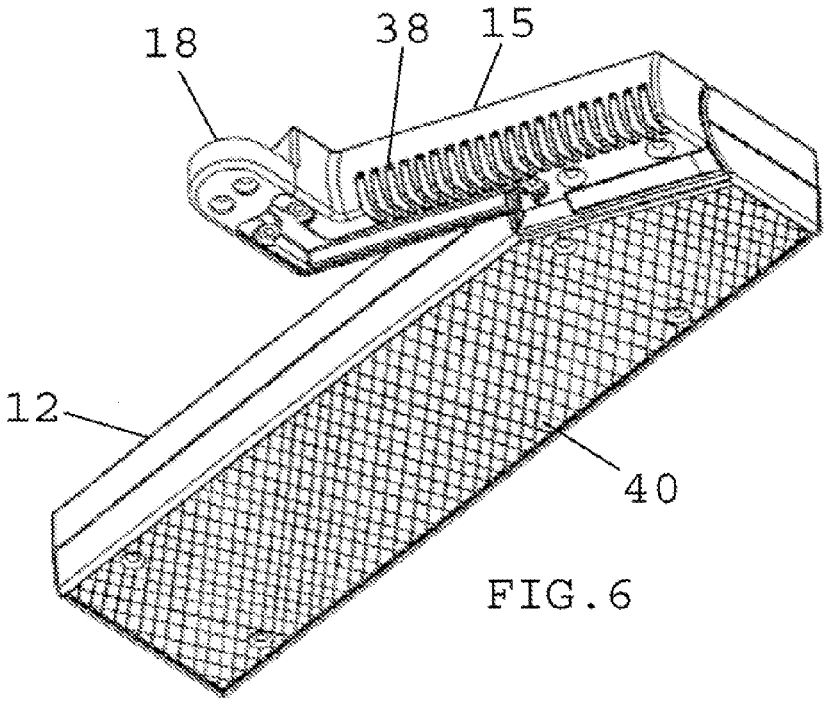
FIG. 6 is a lower perspective view of a further light head.
Figure 7:
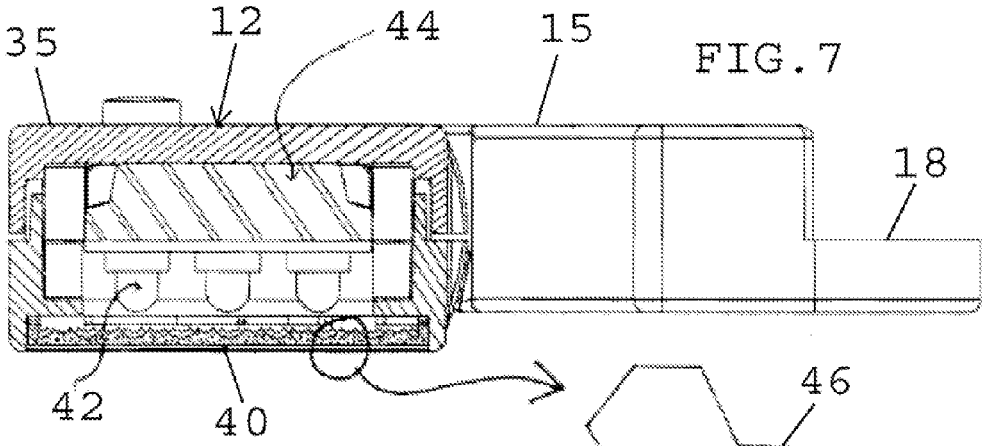
FIG. 7 is a cross sectional view in side elevation of a light head as disclosed herein.
Figure 10:
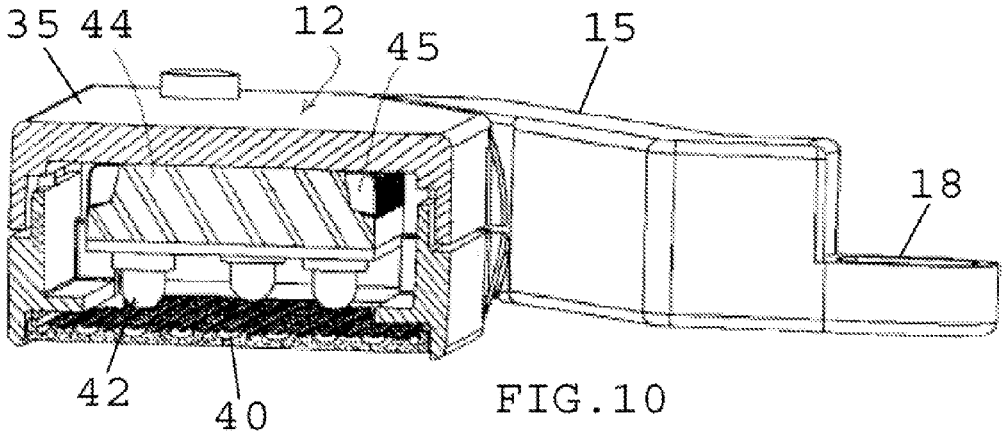
FIG. 10 is a is a cross sectional perspective view of an alternative light head according to the present invention.

The light head 12 and neck 15 are again shown alone in FIGS. 6 and 10. As FIG. 6 illustrates, the neck 15 can function to dissipate heat by the incorporation of a plurality of fins 38 therein. Furthermore, as FIGS. 7 and 10 depict, the light head 12 itself can operate to dissipate heat by the incorporation of a heat conducting slab 44, such as a slab of aluminum or other heat conducting material, to the obverse side of a light source 42, which can comprise an LED light source. Heat dissipating fins 45 or other heat transmitting configurations can be formed integrally with or coupled to the slab 44 or otherwise operably associated with the light source 42. The heat conducting slab 44, the light source 42, and possibly other components can be housed in a shade housing 35.

Figure 8:
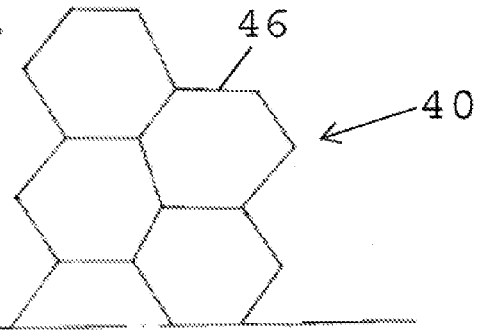
FIG. 8 is a view in top elevation of a portion of a translucent panel for a light head under the present invention.
Figure 9:
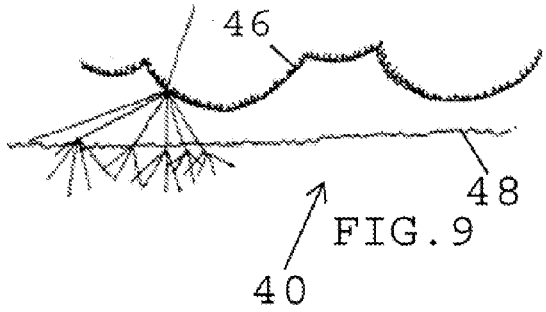
FIG. 9 is a view in side elevation of a portion of the translucent panel of FIG. 8.

With further reference to FIGS. 8 and 9, light emitted from the light source 42 can pass through a translucent or transparent panel 40. Under the present invention, the panel 40 can operate to, among other things, disperse light. The panel 40 can have a first surface, such as the inside surface, that has a plurality of surface anomalies therein, such as by having a plurality of honeycomb 46 formations, each with an arcuate profile. Further, the first surface, which can be the inside surface, can be treated, such as by laser etching or other methods, to have a textured finish, such as a Type AA—Fine texture. The panel 40 can have a second surface, which can be the outside surface, that can also be treated, possibly again by laser etching, to have a textured finish, such as a Type RB—Rough texture. In certain practices of the invention, the panel 40 can be formed from a material of optical clarity.

In any case, when constructed pursuant to the invention, embodiments of the illumination device 10 can achieve bi-symmetric light distribution where light from a single source can be focused in multiple separate and distinct areas thereby, for example, to enable the projection of light onto multiple desired areas while minimizing light on non-desired areas. Under the present invention, it has been found that bi-symmetric light distribution can be facilitated by a selective orientation of light source components, such as LEDS, possibly in combination with formations of the panel 40 as disclosed herein.

Turning to FIGS. 11 through 15, it can be seen that illumination devices 10 pursuant to the instant invention can be controlled by a personal illumination control unit 50. It will be noted that, as is generally shown in the figures, the illumination device 10 in such embodiments can be constructed similarly to the constructions previously described. However, it is equally within the scope of the invention for the illumination device 10 to be of an entirely different construction. The control unit 50 can be wired or wireless.

Figure 11:
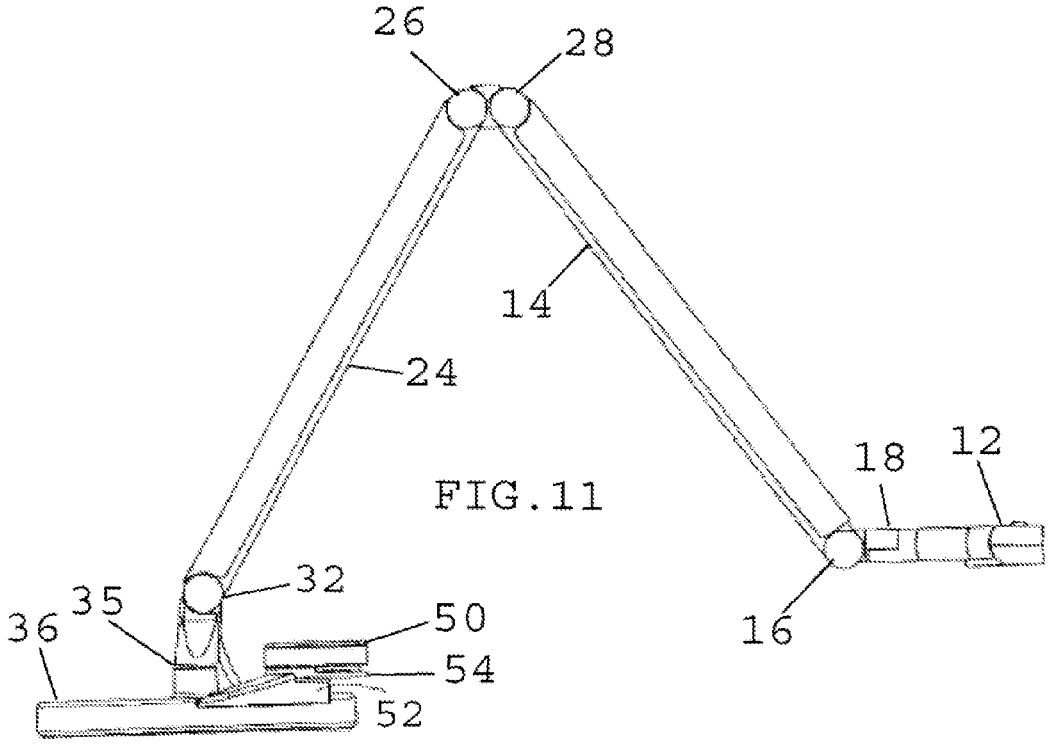
FIG. 11 is a view in side elevation of a further alternative of the illumination device under the instant invention.
Figure 12:
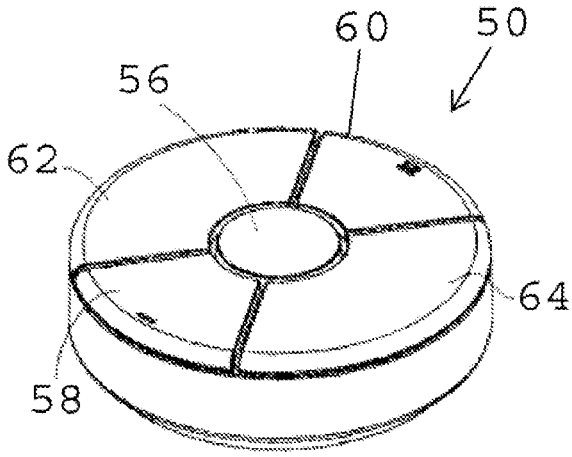
FIG. 12 is a perspective view of a personal illumination control unit as disclosed herein.
Figure 13:
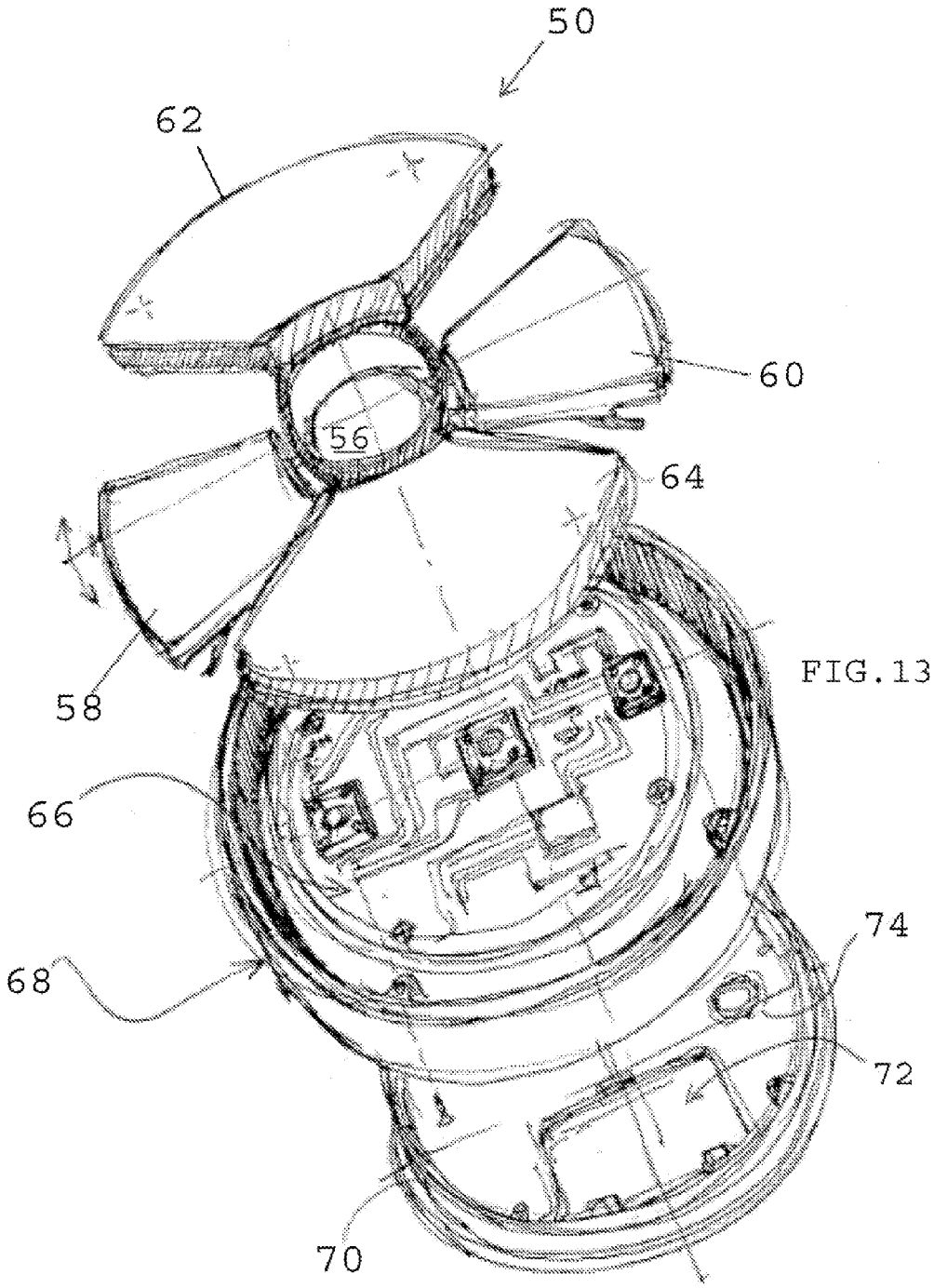
FIG. 13 is an exploded perspective view the personal illumination control unit of FIG. 12.

In certain practices of the invention, as is shown, for example, in FIGS. 11 and 12, the control unit 50 can be removably and replaceably retained in relation to the body of the illumination device 10, such as in relation to the base member 36. For example, the control unit 50 can be removably retained relative to a retaining member 54 by any suitable method, including by mere gravity, by a snap engagement, or by any other means. The retaining member 54 can be merely a portion of the base member 36 or any other portion of the illumination device 10. Alternatively, the retaining member 54 can be a dedicated pedestal as in the depicted embodiments.

Figure 14:
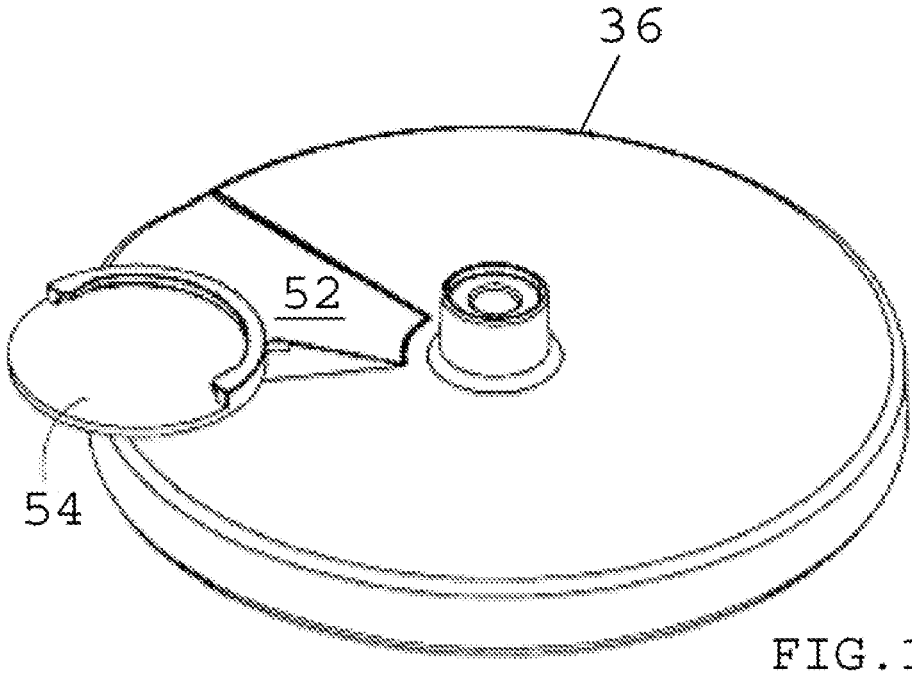
FIG. 14 is a perspective view of a base member adapted for retaining a personal illumination control unit with a retractable platform in an extended disposition.
Figure 15:
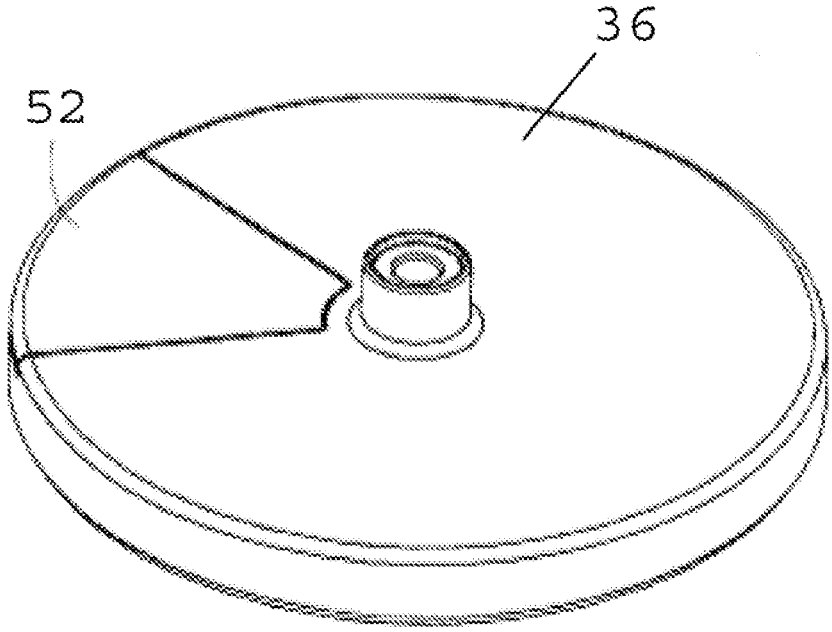
FIG. 15 is a perspective view of the base member of FIG. 14 with the retractable platform in an extended disposition.

The retaining member 54 can be supported by a platform 52, which can be fixed in relation to the base member 36. Alternatively, as FIGS. 14 and 15 show most clearly, the platform 52 and the retaining member 54 can be retractable into the base member 35. With this, the platform 52 and retaining member 54 can be disposed in an extended position as in FIG. 14, and the platform 52 and retaining member 54 can be retracted to a generally concealed position as in FIG. 15.

Figure 16:
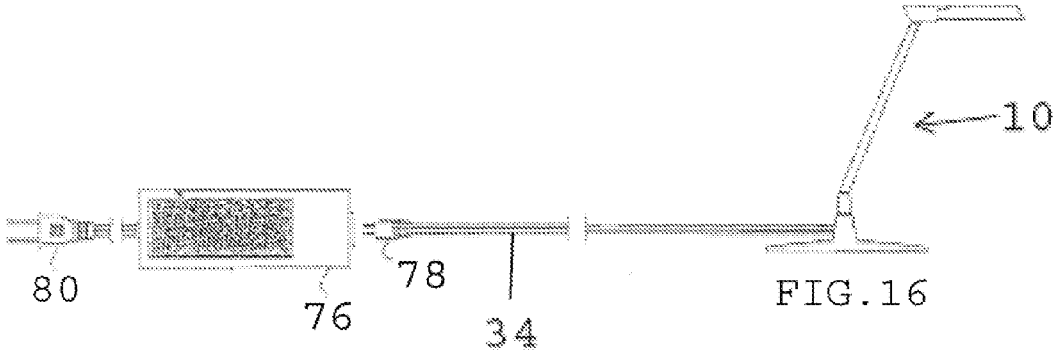
FIG. 16 is a view in side elevation of an illumination device according to the present invention with a first power arrangement.

Looking to FIG. 16, the illumination device 10 can receive power through the power cord 34, which can have a power component housing 76 interposed therealong through a plug and jack combination 78. The plug and jack combination 78 can be a halogen plug and jack, a PL plug and jack, an LED plug and jack, or any other effective arrangement. Ultimately, power can be received from a power source through a wall plug 80.

Figure 17:
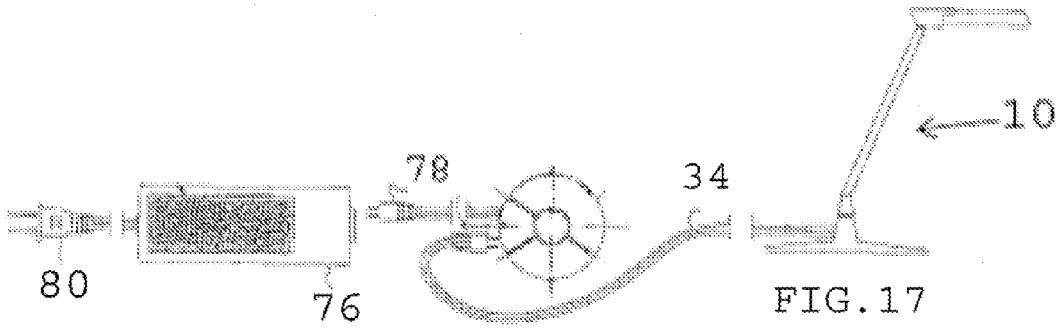
FIG. 17 is a view in side elevation of an illumination device according to the present invention with an alternative power arrangement.
Figure 18:
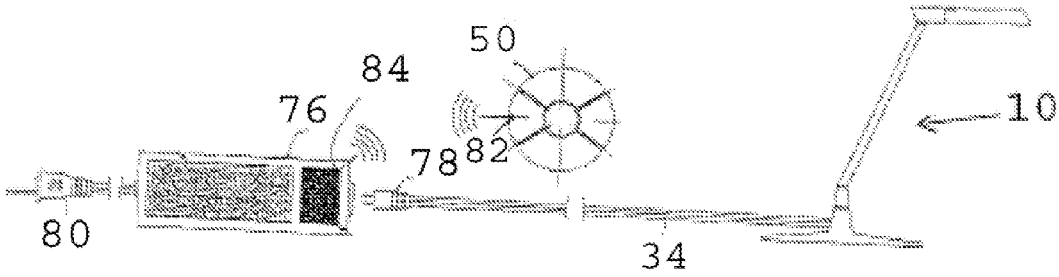
FIG. 18 is a view in side elevation of an illumination device according to the present invention with another alternative power arrangement.

As FIG. 17 shows, the personal illumination control unit 50 can be hard wired into the illumination device 10, such as by being interposed along the power cord 34. As illustrated in FIG. 18, the personal illumination control unit 50 can be wireless. The personal illumination control unit 50 can have a wireless unit 82 electrically associated with the control unit 50 and a wireless unit 84 electrically associated with the power supply to the illumination device 10, such as by being incorporated into the power component housing 76. In either case, the personal illumination control unit 50 can impart lighting and possibly other control commands upon the illumination device 10.

Figure 19:
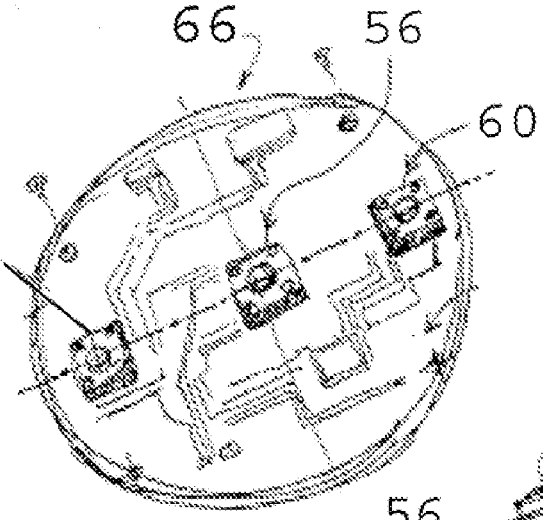
FIG. 19 is a perspective view of a circuit board for use in a personal illumination control unit.
Figure 20:
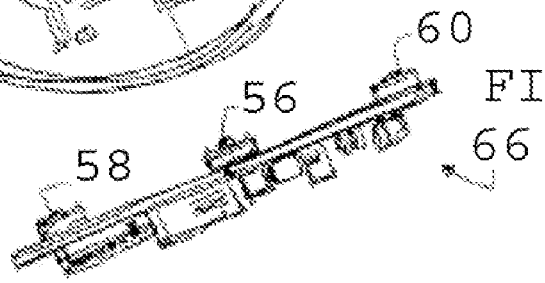
FIG. 20 is a view in side elevation of the circuit board of FIG. 19.
Figure 21:
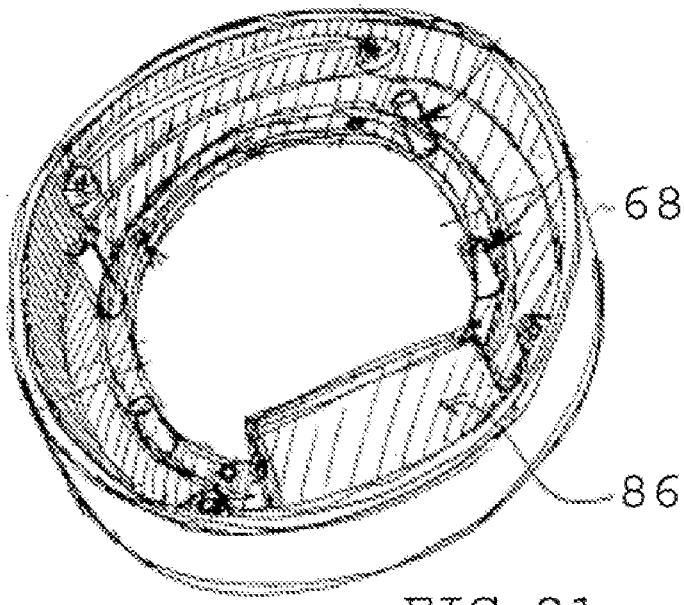
FIG. 21 is a perspective view of a main housing for a personal illumination control unit under the present invention.

A greater understanding of potential embodiments of the personal illumination control unit 50 can be had by referring again to FIGS. 12 and 13 and to FIGS. 19, 20, and 21. The control unit 50, which can be disk shaped, can have an on/off switch 56, which comprises a centrally disposed button in the illustrated embodiments, for turning the light source 42 of the illumination device 10 on and off. A power-lowering switch 58, which can be a wedge-shaped button as illustrated, can cause a selective, progressive dimming of the light source 42. A power-increasing switch 60, which can also comprise a wedge-shaped button, can cause a selective, progressive brightening of the light source 42.

As discussed further hereinbelow, illumination systems under the present invention can have further control buttons, such as those indicated at 62 and 64. The control buttons 62, 64, and possibly others can be employed to control disparate light sources, to affect environmental conditions such as heat, air quality, and odor, or to accomplish substantially any other control function.

Either or both control buttons 62 and 64 can further be employed to bring the light source 42 to a predetermined brightness level that can be preset, such as upon original manufacture of the illumination device 10. Alternatively or additionally, either or both control buttons 62 and 64 can automatically bring the light source 42 to a personally calibrated brightness level that can be individually set by a user by any effective method, including by pressing and holding the respective button 62 or 64 or otherwise causing the control unit 50 to memorize the desired brightness level.

With this, a user can adjust the brightness provided by the light source 42 by selectively manipulating the switches 58 and 60 until a desired brightness level is reached. That brightness level can then be memorized by memory within the control unit 50. Once the personally calibrated brightness level is set, the illumination device 10 can be returned to that level by a simple pressing of the button 62 or 64. Furthermore, the illumination device 10 can include means for inducing the light source 42 to return automatically to the last level of individually set brightness immediately upon being turned on after a period of non-use.

Operation of such controls and the overall operation of the control unit 50 and the illumination device 10 can be partially or completely administered by a circuit hoard 66, which can be disposed in a main housing 68. The main housing 68 can be mounted to a lower housing 70. The lower housing 70 can have a battery door 72 for enabling the insertion and removal of batteries (not shown). The main housing 68 can have an open volume 86 for accommodating the batteries. Also, a remote device connector 74 can be incorporated into the control unit 50.

Figure 22:
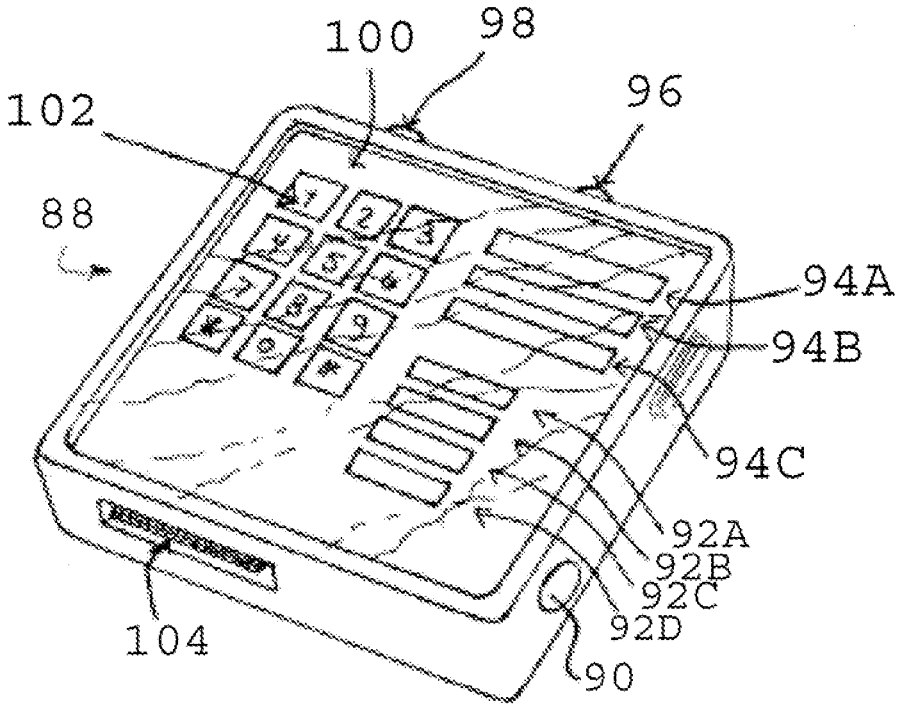
FIG. 22 is a perspective view of an alternative personal illumination control unit.
Figure 23:
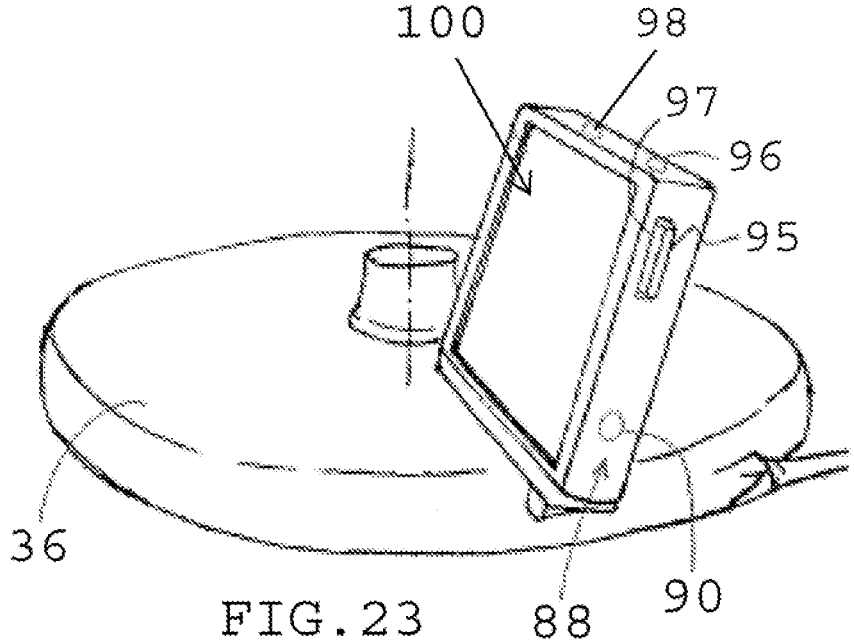
FIG. 23 is a perspective view of the personal illumination control unit of FIG. 22 retained relative to a base member of an illumination device.

An alternative personal illumination control unit is indicated generally at 88 in FIGS. 22 and 23. There, in addition to an on/off switch 90, the control unit 88 has a plurality of what can be termed activity lighting switches 92A, 92B, 92C, and 92D, which automatically bring the illumination device 10, possibly multiple illumination devices 10, to a desired lighting condition corresponding to the activity at hand. For example, reading, computer work, handwriting, precision work, and other dedicated settings, which can be preset or calibrated by the user, can be automatically achieved by an activation of one of the activity lighting switches 92. The control unit 88 can also have user-specific lighting switches 94A, 94B, and 94C for bringing the light source 42 or light sources 42 of an illumination device 10 or illumination devices 10 to settings that are predetermined to be appropriate to particularized characteristics of the user, such as age, weight, and vision capabilities.

Still further, the control unit 88 can have a light meter 96 for sensing ambient lighting conditions and, potentially, adjusting the light emitted by the illumination device 10 at least partially based thereon. A motion sensor 98 can be included to trigger an automatic activation or deactivation of lighting in response to sensed movement or lack thereof in proximity to the control unit 88.

The control unit 88 can additionally incorporate a display panel 100, such as an LCD display panel, that can include a touch-sensitive control keypad 102. A docking connection 104 can enable, for example, external communication and power charging. The docking connection 104 can be operably associated with an internal hard drive to enable a retention of data and images. Furthermore, the control unit 88 can include a memory card slot 97 for removably and replaceably receiving a memory card 95 or other means for retaining or receiving removable memory. With this, a user can load pictures, video, and/or other material onto the control unit 88 to be selectively displayed on the display panel 100.

Figure 24:
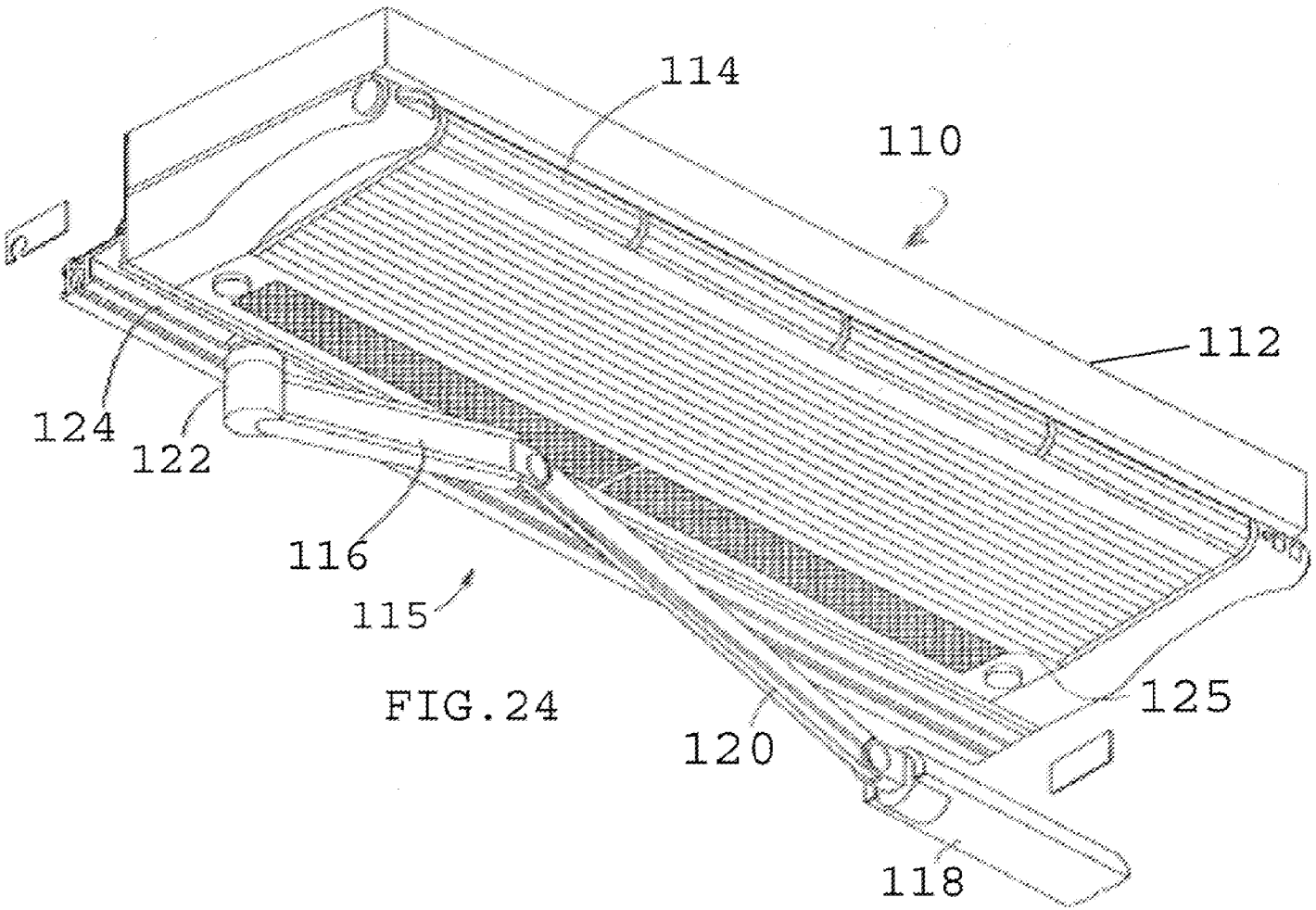
FIG. 24 is a perspective view of a further illumination device according to the invention.

An alternative illumination system 110 according to the invention is illustrated in FIG. 24. There, bi-component illumination is provided by a first lighting device 114 in combination with a second lighting device 115. The first and second lighting devices 114 and 115 can operate independently of one another or possibly in cooperation. As illustrated, the first lighting device 114 in this embodiment comprises an under-cabinet light, which can be mounted below a shelf 112, above or below any other structure, or independently. The second lighting device 115 comprises a task lamp with a moveable disposition. The second lighting device 115 can have a light head 118 retained in relation to a base support 122 by proximal and distal support arms 116 and 120. Pivot axes can be incorporated as desired for the application. The base support 122 can be fixed in place or moveable, such as by being retained in a slide track 124 as in FIG. 24.

The first and second lighting devices 114 and 115 can be controlled by a personal illumination control unit 50 or 88. Within the scope of the invention, the control unit 50 or 88 can control the lighting devices 114 and 115 entirely independently, in partial dependence on one another, and, additionally or alternatively, in an interdependent manner. With this, a user can employ the control unit 50 or 88 to adjust the under-cabinet first light 114 to a given lighting setting while also being able to adjust the task lamp second light 115 to a lighting setting, which can be similar to or different than the lighting setting for the first light 114. For example, the under-cabinet first light 114 can be set to provide low level lighting to a work area while the task lamp second light 115 can be set to provide task lighting to a specific work area.

Figure 25:
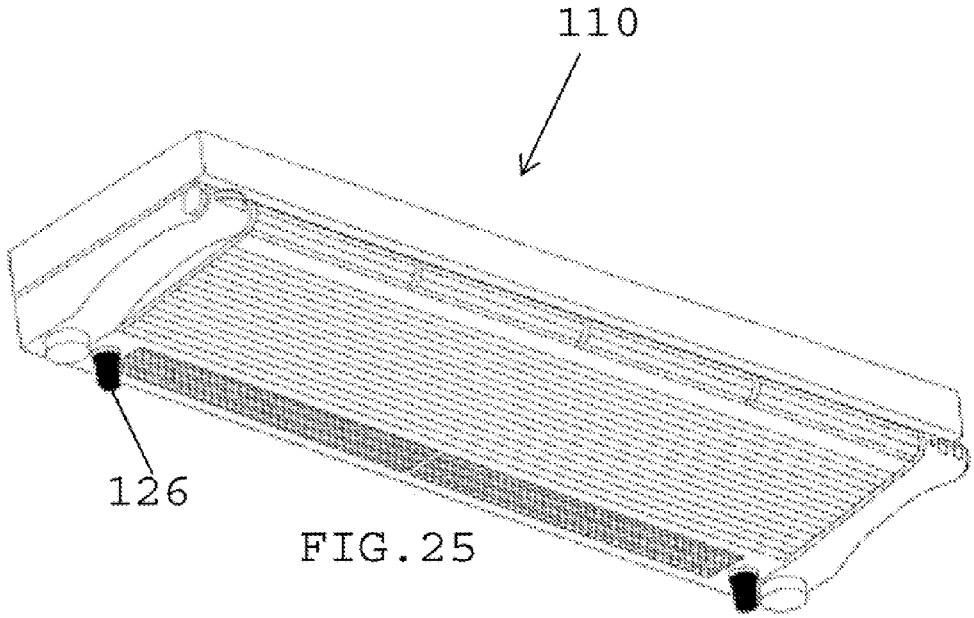
FIG. 25 is a perspective view of another illumination device as disclosed herein.
Figure 26:
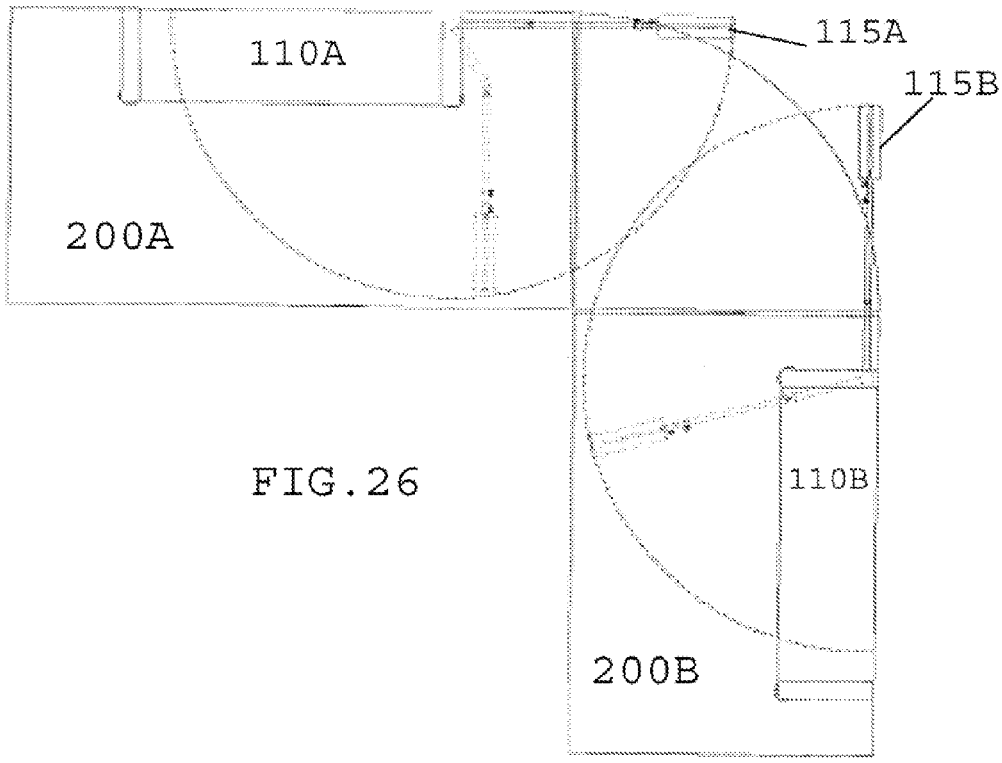
FIG. 26 is a view in top elevation of first and second illumination control systems according to the invention used in combination.

Illumination systems 110 under the present invention can additionally incorporate means for affecting environmental conditions. For example, an ambient air conditioning arrangement 125 could be provided with the capability to filter and purify air, provide heat, add pleasant aromas, or otherwise affect environmental conditions. As in FIG. 25, an ionization system 126 can alternatively or additionally be provided for affecting environmental conditions. As is known in the art, the ionization system 126 can, include a dielectric housing with a circuit for deriving a negative voltage Turning finally to FIG. 26, it will be appreciated that plural illumination systems 110A and 110B can be employed in combination to achieve still more unique advantages. The illumination systems 110A and 110B can be respectively retained, for example, in relation to desks or workstations 200A and 200B. Where moveable lighting devices 115A and 115B are incorporated, the light sources of the same type can be employed in combination and independently to achieve desired lighting effects.

With certain details and embodiments of the present invention for illumination systems and devices disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims are intended to define the scope of protection to be afforded to the inventor. Those claims shall be deemed to include equivalent constructions insofar as they do not depart from the spirit and scope of the invention. It must be further noted that a plurality of the following claims express certain elements as means for performing a specific function, at times without the recital of structure or material. As the law demands, these claims shall be construed to cover not only the corresponding structure and material expressly described in this specification but also all equivalents thereof.

I claim:

1. An illumination system comprising:

an illumination device with a body portion and a light source for emitting light;

a personal illumination control unit with means for enabling an input of light source control commands; and means for communicating light source control commands from the personal illumination control unit to the illumination device wherein the means for enabling an input of light source control commands of the personal illumination control unit comprises an on/off switch for turning the light source on and off, means for inducing a selective brightening of the light source, and a means for inducing a selective dimming of the light source, wherein the personal illumination control unit is generally disk shaped, and wherein the means for inducing a selective brightening of the light source and the means for inducing a selective dimming of the light source comprise truncated wedge-shaped buttons;

wherein the personal illumination control unit is removably and replaceably received relative to the body portion of the illumination device, wherein the illumination device has a base member and a platform retained relative to the base member for removably and replaceably receiving the personal illumination control unit, and wherein the platform is extendable and retractable relative to the base member.

2. The illumination system of claim 1 wherein the means for communicating light source control commands comprises a wireless arrangement.

3. The illumination system of claim 1 wherein the means for enabling an input of light source control commands of the personal illumination control unit further comprises a means for inducing the light source to a predetermined, personally calibrated brightness level.

4. The illumination system of claim 1 further comprising a means for inducing the light source to a predetermined brightness level wherein the means for inducing the light source to a predetermined brightness level comprises electronic memory within the personal illumination control unit and for retaining a given brightness level of the light source which given brightness level has been personally calibrated by either or both of the means for inducing a selective brightening of the light source and the means for inducing a selective dimming of the light source, means for causing the electronic memory to memorize the given brightness level, and a means for automatically returning the light source to the given brightness level personally calibrated by either or both of the means for inducing a selective brightening of the light source and the means for inducing a selective dimming of the light source and memorized by the electronic memory automatically upon actuation of the means for automatically inducing the light source to the given brightness level.

5. The illumination system of claim 4 wherein the means for causing the electronic memory to memorize the given brightness level comprises a button disposed on the personal illumination control unit wherein the button induces a retention of a given, personally calibrated brightness level.

6. The illumination system of claim 4 wherein the means for inducing the light source to a predetermined brightness level comprises a means for inducing the light source to a level of brightness upon being turned on that is approximately equal to an individually set level of brightness to which the light source was set prior to being turned off.

7. The illumination system of claim 4 wherein the means for communicating light source control commands of the personal illumination control unit further comprises plural separate means for inducing the light source to predetermined brightness levels.

* * * * *